US010589549B2

(12) United States Patent
Ishida et al.

(10) Patent No.: US 10,589,549 B2
(45) Date of Patent: Mar. 17, 2020

(54) CARRIAGE STRUCTURE AND PRINTER

(71) Applicant: SEIKO EPSON CORPORATION, Tokyo (JP)

(72) Inventors: Tetsugo Ishida, Yamagata (JP); Takumi Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 290 days.

(21) Appl. No.: 15/483,818

(22) Filed: Apr. 10, 2017

(65) Prior Publication Data

US 2017/0297353 A1 Oct. 19, 2017

(30) Foreign Application Priority Data

Apr. 15, 2016 (JP) ..... 2016-081979

(51) Int. Cl.

| | |
|---|---|
| ***B41J 25/00*** | (2006.01) |
| ***B41J 11/00*** | (2006.01) |
| ***B41J 11/48*** | (2006.01) |
| ***B41J 15/04*** | (2006.01) |

(52) U.S. Cl.

CPC ..... *B41J 25/006* (2013.01); *B41J 11/005* (2013.01); *B41J 11/006* (2013.01); *B41J 11/48* (2013.01); *B41J 15/042* (2013.01)

(58) Field of Classification Search

CPC ..... B41J 25/006; B41J 11/005; B41J 11/006; B41J 11/48; B41J 11/0045; B41J 11/007; B41J 11/008; B41J 3/06; B41J 15/042; B41J 15/304; B41J 25/3086; B41J 25/3088

See application file for complete search history.

(56) References Cited

U.S. PATENT DOCUMENTS

2014/0111587 A1 4/2014 Nakano et al.
2015/0283826 A1* 10/2015 Nakano ..... B41J 11/0005 347/104

FOREIGN PATENT DOCUMENTS

| | | |
|---|---|---|
| JP | 2011-201224 | 10/2011 |
| JP | 2012-101387 | 5/2012 |
| JP | 2014-083707 | 5/2014 |
| JP | 2015-066715 | 4/2015 |

* cited by examiner

*Primary Examiner* — Sharon A. Polk
(74) *Attorney, Agent, or Firm* — Workman Nydegger

(57) ABSTRACT

Provided are a carriage structure capable of preventing a carriage from contacting a side edge of a print medium, without requiring a discharge roller and facilitating reducing device size, and a printer having the carriage structure. Disposed to a carriage 21 carrying and inkjet head 22 and moving bidirectionally through a range of movement including the conveyance path of a cut-sheet paper S are: a panel member 78 able to protrude in the direction of carriage 21 movement; and a moving mechanism 126 causing the panel member 78 to protrude to the conveyance path of the cut-sheet paper S when the carriage 21 is at a standby position (home position) set in the range of carriage 21 movement.

4 Claims, 9 Drawing Sheets

CARRIAGE STRUCTURE AND PRINTER

CROSS-REFERENCE TO RELATED APPLICATIONS

The entire disclosure of Japanese Patent Application No: 2016-081979, filed Apr. 15, 2016 is expressly incorporated by reference herein in its entirety.

BACKGROUND

1. Technical Field

The present invention relates to a carriage structure and to a printer.

2. Related Art

JP-A-2011-201224 describes a printer that prevents paper on the platen from lifting away from the platen (referred to below as paper uplift). This printer has a conveyance roller and a discharge roller, and prevents paper uplift by constantly keeping the paper taut between the conveyance roller and discharge roller.

The configuration described in JP-A-2011-201224 cannot be used in a printer in which a discharge roller cannot be provided, and paper uplift from the platen can result in the carriage catching on the edges of paper lifted up from the platen, resulting in paper conveyance problems. If the width of the carriage is increased so that the carriage constantly overlaps the conveyance range of the paper, thereby preventing contact between the paper edge and carriage, the size of the printer increases accordingly.

SUMMARY

An objective of the present invention is to provide a carriage structure, and a printer using the carriage structure, that can prevent the carriage from catching on an edge of the paper and enable reducing the device size by not requiring a discharge roller.

To achieve the foregoing objective, a carriage structure according to the invention has, disposed to a carriage that carries a printhead and moves bidirectionally through a range of movement including a conveyance path of a print medium: a protrusion able to protrude in the direction of carriage movement; and a moving mechanism causing the protrusion to protrude to the print medium conveyance path side when the carriage is at a standby position set in the range of movement of the carriage.

By the moving mechanism causing the protrusion to protrude from the carriage at the standby position in front of the conveyance path of the print medium, this configuration can, without using a discharge roller and drive mechanism for the discharge roller, prevent the print medium from falling into the path of carriage movement and the carriage running into the side edge of the print medium. As a result, cost and size can be reductions can be achieved without causing problems with conveyance of the print medium.

In a carriage structure according to another aspect of the invention, the moving mechanism stores the protrusion beside the carriage when the carriage moves from the standby position to the print medium conveyance path side.

This configuration can minimize how much the protrusion extends from the carriage in the direction of carriage movement, and helps reduce the size of a printer in which the carriage is disposed.

In a carriage structure according to another aspect of the invention, the protrusion is a panel member having one end part thereof pivotably supported on the carriage; and the moving mechanism includes a link member connected pivotably to the other end of the panel member and supported slidably to the carriage, and an urging member pulling the panel member to the carriage. When the carriage is at the standby position, the link member touches a stationary contact part outside the range of carriage movement and protrudes with the panel member to the print medium conveyance path side.

By configuring the protrusion with a panel member, this configuration can, by the panel member, more reliably prevent the print medium from falling forward, and by the moving mechanism can swing and store the panel member beside the carriage, thereby enabling reducing the size of the printer in which the carriage is used. Furthermore, because movement of the carriage to the standby position causes the link member to contact the contact part (stop), the panel member can be made to automatically project to the print medium conveyance path side, does not require a drive source to specifically make the panel member protrude, and cost increases can thereby be suppressed.

In a carriage structure according to another aspect of the invention, the moving mechanism includes multiple rods supported slidably in relation to the carriage with one end fastened to the protrusion, and an urging member pulling the rods to the carriage. When the carriage is at the standby position, the rods touch a stationary contact part outside the range of carriage movement and cause the protrusion to protrude to the print medium conveyance path side.

This configuration helps reduce the size of the printer in which the carriage is used because the protrusion can be moved by the moving mechanism and stored near the carriage. Furthermore, because movement of the carriage to the standby position causes the rod to contact the contact part (stop), the protrusion can be made to automatically project to the print medium conveyance path side, does not require a drive source to specifically project the protrusion, and cost increases can thereby be suppressed.

Another aspect of the invention is a printer that has a printhead, and a carriage carrying the printhead, prints by moving the carriage bidirectionally through a range of movement including the conveyance path of a print medium, and includes: disposed to the carriage, a protrusion able to protrude in the direction of carriage movement; and a moving mechanism causing the protrusion to protrude to the print medium conveyance path side when the carriage is at a standby position set in the range of movement of the carriage.

By the moving mechanism causing the protrusion to protrude from the carriage at the standby position in front of the conveyance path of the print medium, this configuration can, without using a discharge roller and drive mechanism for the discharge roller, prevent the print medium from falling into the path of carriage movement and the carriage running into the side edge of the print medium. As a result, printer cost and size can be reduced without causing problems with conveyance of the print medium.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Embodiment 1

Figure 1:
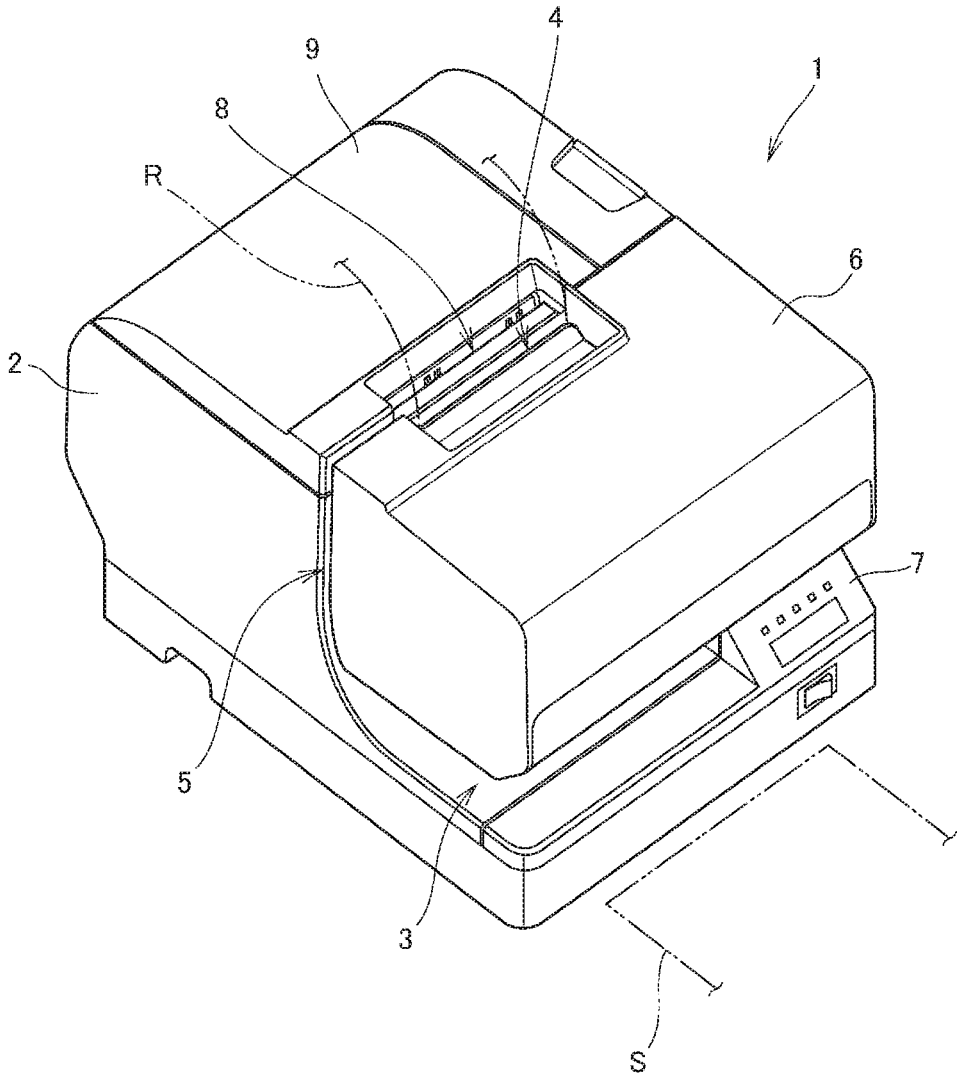
FIG. 1 is an oblique view of a printer according to a first embodiment of the invention.

FIG. 1 is an oblique view of a printer 1 according to the first embodiment of the invention.

FIG. 1 shows the printer 1 as it is placed when in use. When in use, the printer 1 is placed on a flat surface such as a desk or dedicated stand. The printer 1 is a device that executes a printing process to print text (including symbols) and images (including various graphics or illustrations) on cut-sheet paper S or roll paper R. FIG. 1 is a view of the printer 1 from above the front left side. The front as seen in FIG. 1 is referred to as the front of the printer 1, and the opposite end is referred to as the back of the printer 1. The left and right sides of the printer 1 are the left and right sides when looking at the printer 1 from the front.

The printer 1 connects, for example, to a POS terminal (not shown in the figure) that executes a transaction process based on a sales transaction, and based on commands and data input from the POS terminal, prints a receipt or ticket showing the result of the transaction process on roll paper R. The printer can also print information including the payee, date, and payment amount, for example, on the front of a check or other payment ticket as examples of cut-sheet paper S.

The printer 1 has a printer case 2 shaped basically like a rectangular box, and has a paper entrance 3 for inserting cut-sheet paper S formed in the front left part of the printer case 2. The paper entrance 3 is formed with a specific width along the width of the printer 1. A paper exit 4 from which processed cut-sheet paper S is discharged is formed approximately in the middle between the front and back of the top of the printer case 2 with a specific width along the width of the printer 1.

A media conveyance path 5 is formed between the paper entrance 3 and paper exit 4, extending toward the back from the paper entrance 3 and then curving up to the paper exit 4. The paper entrance 3, paper exit 4, and media conveyance path 5 are open to the left side of the printer case 2, enabling conveying cut-sheet paper S that is wider than the paper entrance 3, paper exit 4, and media conveyance path 5.

The cut-sheet paper S is a cut sheet of a specific size of paper or plastic media, and may be a check, ledger form, or other type of media to which a specific surface process has been applied. The cut-sheet paper S is inserted by the user of the printer 1 to the paper entrance 3 for manual printing.

The top of the printer case 2 is covered by a front cover 6 on the front side of the paper exit 4. An operating panel 7 is also disposed at the front of the printer case 2. The operating panel 7 includes switches for operating the printer 1, and indicators for displaying the operating status of the printer 1. The operating panel 7 may also have a display for displaying the operating status of the printer 1.

Also disposed widthwise to the printer 1 in part of the paper exit 4 in the top of the printer case 2 is a roll paper exit 8 from which roll paper R is discharged after printing.

The roll paper exit 8 is formed from the middle of the width of the paper exit 4 to the right side edge of the paper exit 4.

An access cover 9 is disposed to the top of the printer case 2 behind the roll paper exit 8, and the access cover 9 is attached to the printer case 2 pivotably at the back end of the access cover 9. Opening the access cover 9 exposes the roll paper compartment 58 (see FIG. 3) that holds the roll paper R, and enables replacing the roll paper R. The roll paper R is continuous plain paper wound into a roll around a core.

Figure 2:
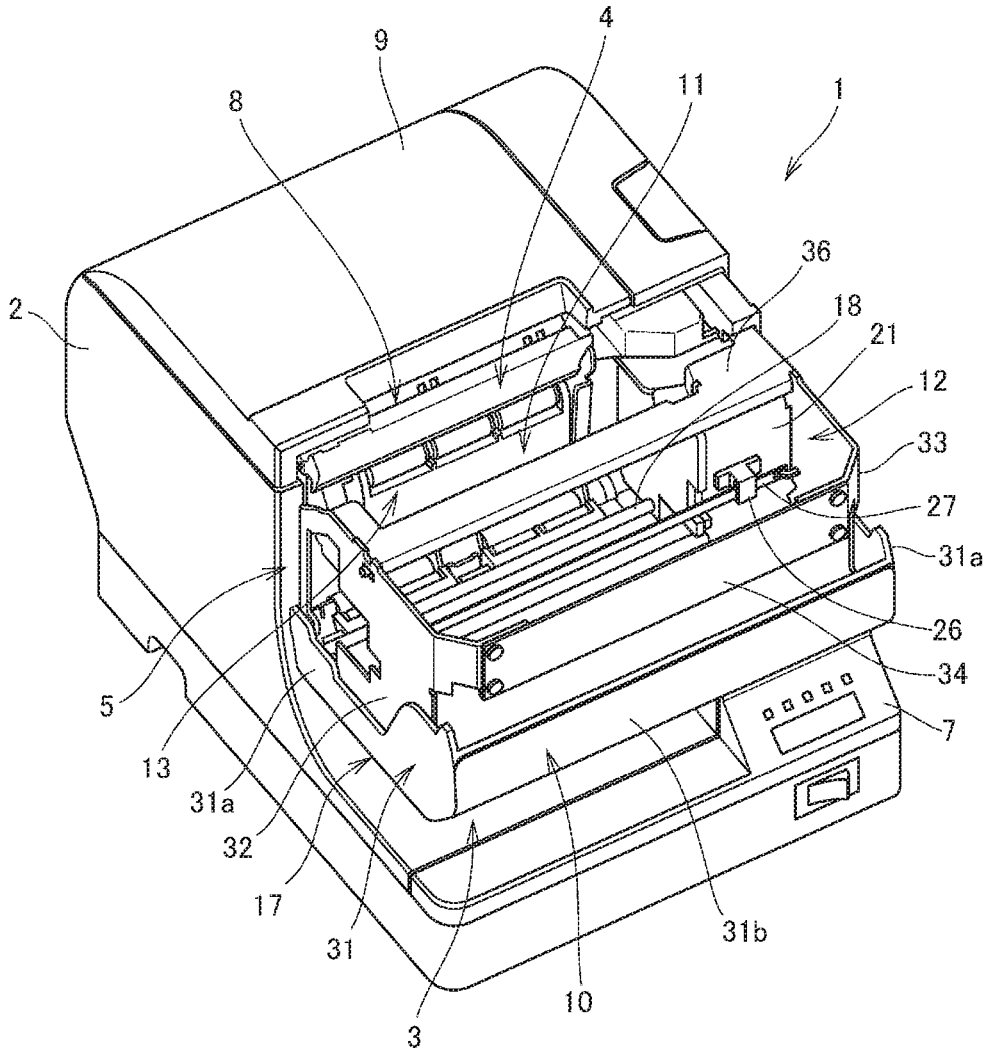
FIG. 2 is an oblique view of the printer with the front cover removed from the main case.

FIG. 2 is an oblique view of the printer 1 with the front cover 6 removed from the printer case 2.

The printer 1 has a main assembly 11 inside the printer case 2. The main assembly 11 includes a slip conveyance unit 12 that conveys cut-sheet paper S (FIG. 1) and applies the printing process to cut-sheet paper S and roll paper R; and a roll paper conveyance unit 13 that conveys the roll paper R.

The front cover 6 is part of the print unit 10.

The print unit 10 has an ink cartridge (not shown in the figure) inside, and the ink cartridge can be replaced by opening the front cover 6.

The slip conveyance unit 12 includes a front frame 17, guide rail 18, carriage 21, inkjet head 22, carriage drive motor (not shown in the figure), timing belt (not shown in the figure), carriage sensor 26, and scale 27.

The front frame 17 includes abase frame 31, left side frame 32, right side frame 33, front connector frame 34, and top connector frame 36.

The base frame 31 includes left and right side walls 31*a*, 31*a*, and a front wall 31*b* connecting the side walls 31*a*, 31*a*. The left side frame 32 and right side frame 33 rise respectively from the left and right ends of the base frame 31. The front connector frame 34 extends widthwise to the printer and connects the front ends of the left side frame 32 and right side frame 33. The top connector frame 36 extends widthwise to the printer and connects the top ends of the left side frame 32 and right side frame 33.

The guide rail 18 is attached extending widthwise to the printer 1 between the left side frame 32 and right side frame 33 of the front frame 17.

The carriage 21 carries the inkjet head 22, and is driven through the timing belt by drive power from the carriage drive motor (not shown in the figure) to move bidirectionally along the guide rail 18.

The inkjet head 22 forms characters and images on cut-sheet paper S and roll paper R by ejecting ink stored in an ink cartridge onto the surface (printing surface) of the cut-sheet paper S or roll paper R conveyed through the media conveyance path 5.

The carriage sensor 26 is a transmissive photosensor that detects the location of the carriage 21, is disposed to the front of the carriage 21, and scans the scale 27 disposed along the guide rail 18 as the carriage 21 moves bidirectionally. The scale 27 has numerous slits of a specific width, and the carriage sensor 26 detects displacement of the carriage 21 and detects the location of the carriage 21 by acquiring optical signals that pass through the slits when scanning the scale 27.

Figure 3:
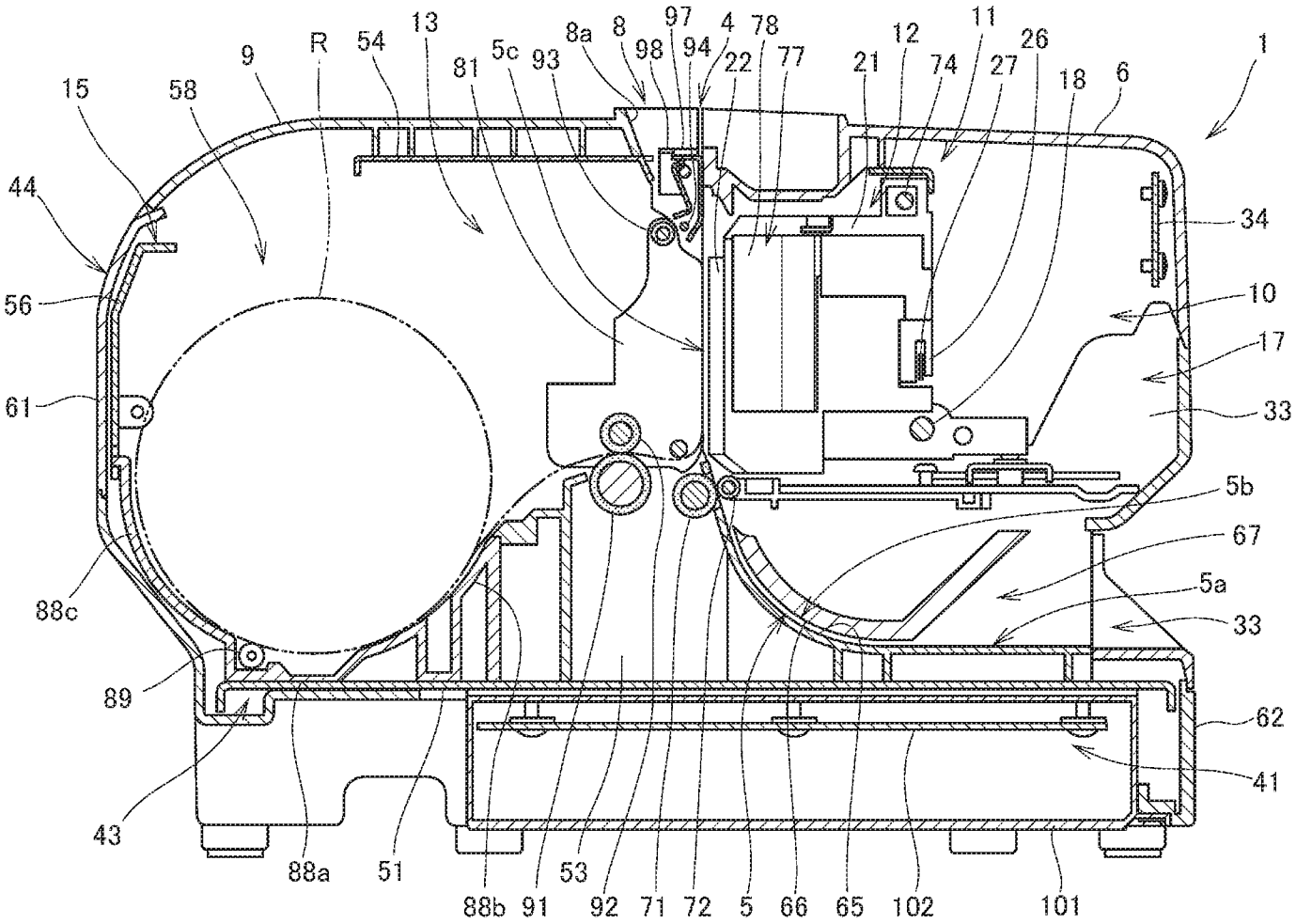
FIG. 3 is a section view showing main parts of the printer.

FIG. 3 is a section view showing main parts of the printer 1.

The printer 1 has a main assembly 11 for executing the printing process, a controller 41 that controls the main assembly 11, a frame assembly 43 that supports the main assembly 11 and controller 41, and a cover 44 that covers the frame assembly 43.

The frame assembly 43 includes the front frame 17 and the 15.

The 15 includes a base frame 51, left side frame (not shown in the figure), right side frame 53, top frame 54, and back frame 56.

The base frame 51 is disposed at the bottom of the printer 1 covering approximately the length between the front and back of the printer 1. The left side frame and right side frame 53 rise from the left and right ends of the base frame 51. The top frame 54 connects the tops of the left side frame and the right side frame 53. The back frame 56 connects the back ends of the left side frame and the right side frame 53.

The cover 44 includes the front cover 6, a back cover 61, the access cover 9, and a bottom cover 62.

The front cover 6 is disposed to the print unit 10, and covers the slip conveyance unit 12. The back cover 61 covers part of the left and right sides and the back of the printer 1, except for the print unit 10. The access cover 9 is attached so that it can open at the back top part of the back cover 61, and covers the top of the slip conveyance unit 12. The bottom cover 62 covers the front, back, and left and right sides of the bottom of the printer 1.

The slip conveyance unit 12 is disposed in the front, and the roll paper conveyance unit 13 is disposed in the back, of the main assembly 11.

The slip conveyance unit 12 includes components related to conveying the cut-sheet paper S, and more specifically includes a conveyance roller 71 and follower roller 72 described below, and in this configuration includes a lower guide surface 65, upper guide surface 66, media guide member 67, the paper entrance 3, and the paper exit 4.

The roll paper conveyance unit 13 includes components related to conveying roll paper R. More specifically, the roll paper conveyance unit 13 includes a conveyance roller 91, follower roller 92, conveyance roller 93, and follower roller 94, and in this configuration includes the roll paper compartment 58, roll paper holder 88, and roll paper exit 8.

The platen 81 described below is located between the slip conveyance unit 12 and roll paper conveyance unit 13, and may be considered part of both the slip conveyance unit 12 and roll paper conveyance unit 13. The media conveyance path 5 may also be considered part of the slip conveyance unit 12, but part of the media conveyance path 5 may also be thought of as included in the conveyance path through which the roll paper R is conveyed.

A top and bottom pair of media guide members 67 forming the lower guide surface 65 and upper guide surface 66 are disposed to the 15, and the gap between the lower guide surface 65 and upper guide surface 66 is formed as the media conveyance path 5.

The media conveyance path 5 includes a horizontal path 5*a* extending from the paper entrance 3 toward the back, a curved path 5*b* curving up from the back end of the horizontal path 5*a*, and a vertical path 5*c* continuing up from the top end of the curved path 5*b* to the paper exit 4.

The conveyance roller 71 and follower roller 72 are respectively disposed, in mutual opposition on the curved path 5*b* of the media conveyance path 5, to the lower guide surface 65 and upper guide surface 66. The conveyance roller 71 turns as driven by a conveyance motor (not shown in the figure), and conveys the cut-sheet paper S held between the conveyance roller 71 and follower roller 72.

As described above, the vertical path 5*c* of the media conveyance path 5 conveys both cut-sheet paper S and roll paper R, and may therefore be considered to configure a common conveyance path. For example, when roll paper R is set in the roll paper compartment 58, pulled from the roll paper compartment 58 and positioned on the vertical path 5*c*, and cut-sheet paper S is inserted from the paper entrance 3 and conveyed, the cut-sheet paper S and roll paper R will overlap on the vertical path 5*c*. In this event, the printer 1 can convey both the cut-sheet paper S and roll paper R.

In addition to guide rail 18, the carriage 21 of the slip conveyance unit 12 is also supported movably widthwise to the printer 1 on a guide rail 74, and a paper support mechanism 77 that prevents cut-sheet paper S from falling into the path of carriage 21 movement is disposed at the side and top of the carriage 21.

The guide rail 74 extends widthwise to the printer 1 between the left side frame 32 and right side frame 33.

The paper support mechanism 77 has a panel member 78 capable of protruding in front of the cut-sheet paper S. The panel member 78 is configured so that it can be stored by swinging from the path of carriage 21 movement to the side of the carriage 21.

The inkjet head 22 has a nozzle row of multiple nozzles in a line along the vertical axis. The inkjet head 22 is disposed with the nozzle face in which the nozzles are disposed facing the vertical path 5*c*. The platen 81 that defines the printing position of the inkjet head 22 is disposed to the roll paper conveyance unit 13 opposite the nozzle face with the vertical path 5*c* therebetween. Ink is supplied to the inkjet head 22 from an ink cartridge (not shown in the figure), which is the ink supply source installed in an ink cartridge holder (not shown in the figure) inside the print unit 10. The platen 81 and inkjet head 22 are thus disposed facing each other on opposite sides of the vertical path 5*c* of the media conveyance path 5, and deposit ink on the roll paper R or cut-sheet paper S on the vertical path 5*c*.

The roll paper conveyance unit 13 includes a roll paper holder 88 disposed between the pair of left and right side frames, that is, the left side frame (not shown in the figure) and the right side frame 53. The roll paper holder 88 forms the bottom 88*a*, front wall 88*b*, and back wall 88*c* of the roll paper compartment 58. The bottom 88*a*, front wall 88*b*, and back wall 88*c* of the roll paper holder 88 roughly form a semicircle when seen from the side to easily hold the a roll of roll paper R, and a roller 89 is disposed to the bottom 88*a* to support and facilitate rotation of the paper roll R. Because the roller 89 can rotate while supporting the weight of the roll paper R from below, the roll paper R is supported freely rotatably, and free rotation of the roll paper R in the roll paper compartment 58 is assured.

A conveyance roller 91 and follower roller 92 pair is disposed in front of the front wall 88*b*. The conveyance roller 91 is connected to a roll paper conveyance motor (not shown in the figure), and rotates as driven by the roll paper conveyance motor (not shown in the figure). The conveyance roller 91 and follower roller 92 hold the roll paper R delivered from the roll paper compartment 58, and convey the roll paper R to the vertical path 5*c* by turning as driven by the roll paper conveyance motor.

A conveyance roller 93 and follower roller 94 pair is disposed freely rotatably in mutual opposition near the roll paper exit 8 between the left side frame and right side frame 53. The conveyance roller 93 is connected to the roll paper conveyance motor (not shown in the figure), and rotates as driven by the roll paper conveyance motor (not shown in the figure). The conveyance roller 93 and follower roller 94 are located on the downstream side of the vertical path 5*c*, and hold the roll paper R after printing by the inkjet head 22, and convey the roll paper R to the roll paper exit 8.

The roll paper conveyance motor (not shown in the figure) is disposed to the left side frame, rotation of the roll paper conveyance motor is transferred through a gear (not shown in the figure) to the conveyance rollers 91, 93 and a drive gear (not shown in the figure) formed coaxially to the conveyance rollers, and the conveyance rollers 91, 93 turn.

A cutter support member 97, and a cutter blade supported by the cutter support member 97, are disposed at the roll paper exit 8. The cutter blade is a fixed blade with a sawtooth cutting edge, for example, and the leading end of the roll paper R passes between the cutter blade and the back slope 8*a* forming the back of the roll paper exit 8, and out from the roll paper exit 8. The roll paper R can be cut by the user holding the leading end of the roll paper R discharged from the roll paper exit 8 to the outside of the printer 1, and pulling the roll paper R across the cutter blade. A remaining roll paper sensor (not shown in the figure) that detects how much roll paper R is left inside the roll paper compartment 58 is disposed to the left side frame.

A box 101 is attached to the bottom of the base frame 51, and the controller 41 is disposed inside the box 101. The controller 41 has a circuit board 102 to which control components that control the slip conveyance unit 12 and roll paper conveyance unit 13 are disposed.

Figure 4:
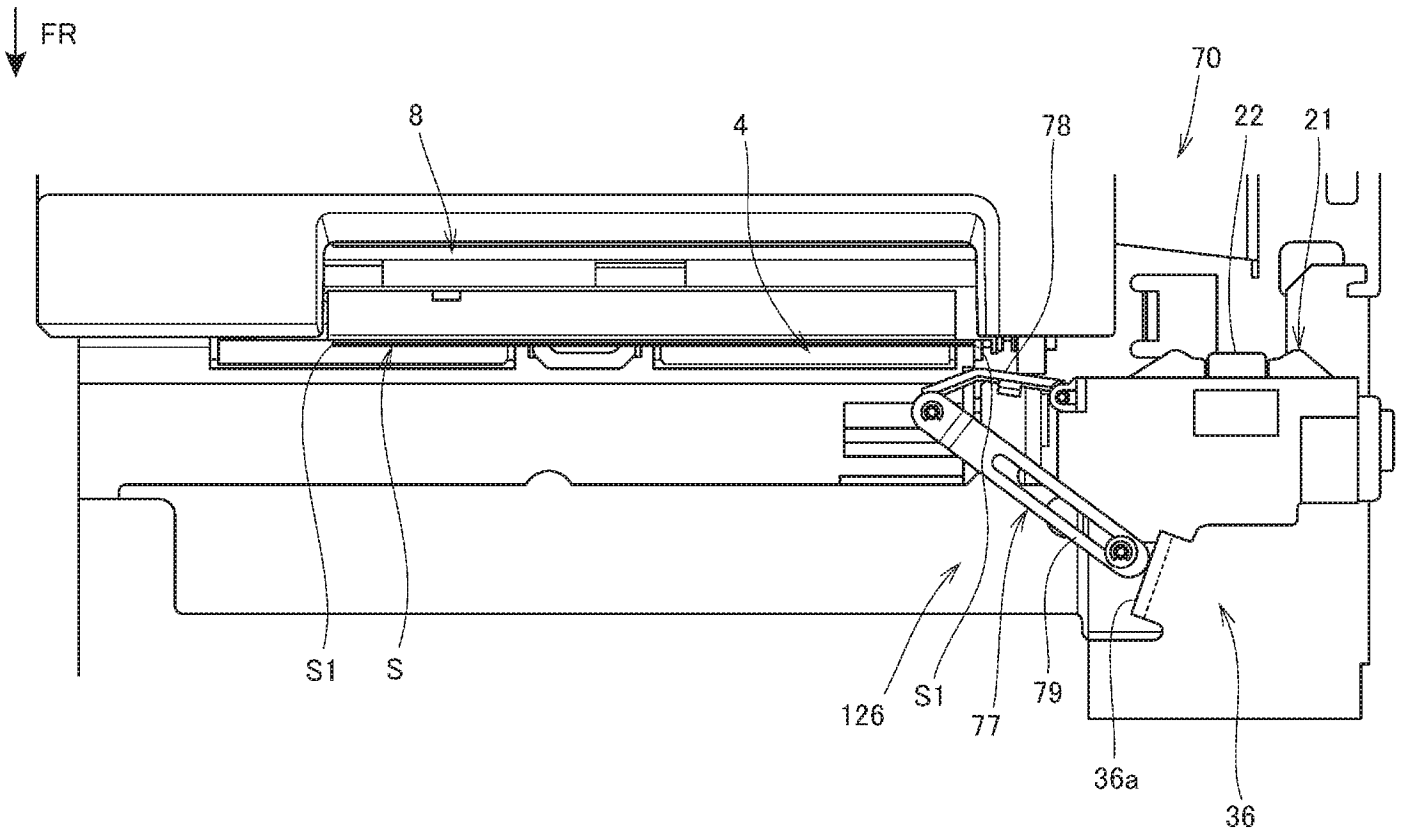
FIG. 4 is a plan view showing main parts of the carriage and surrounding.

FIG. 4 is a plan view showing the carriage 21 and main surrounding parts. Note that arrow FR in the figures point to the front of the printer 1 (see FIG. 1).

The home position of the carriage 21 is set at the right end of the range of carriage 21 movement, and when not printing on cut-sheet paper S, the carriage 21 waits at the home position as shown in the figure.

The panel member 78 of the paper support mechanism 77 is connected to the carriage 21 to protrude to the left side. The carriage 21 and the paper support mechanism 77 embody a carriage assembly 70.

Figure 5:
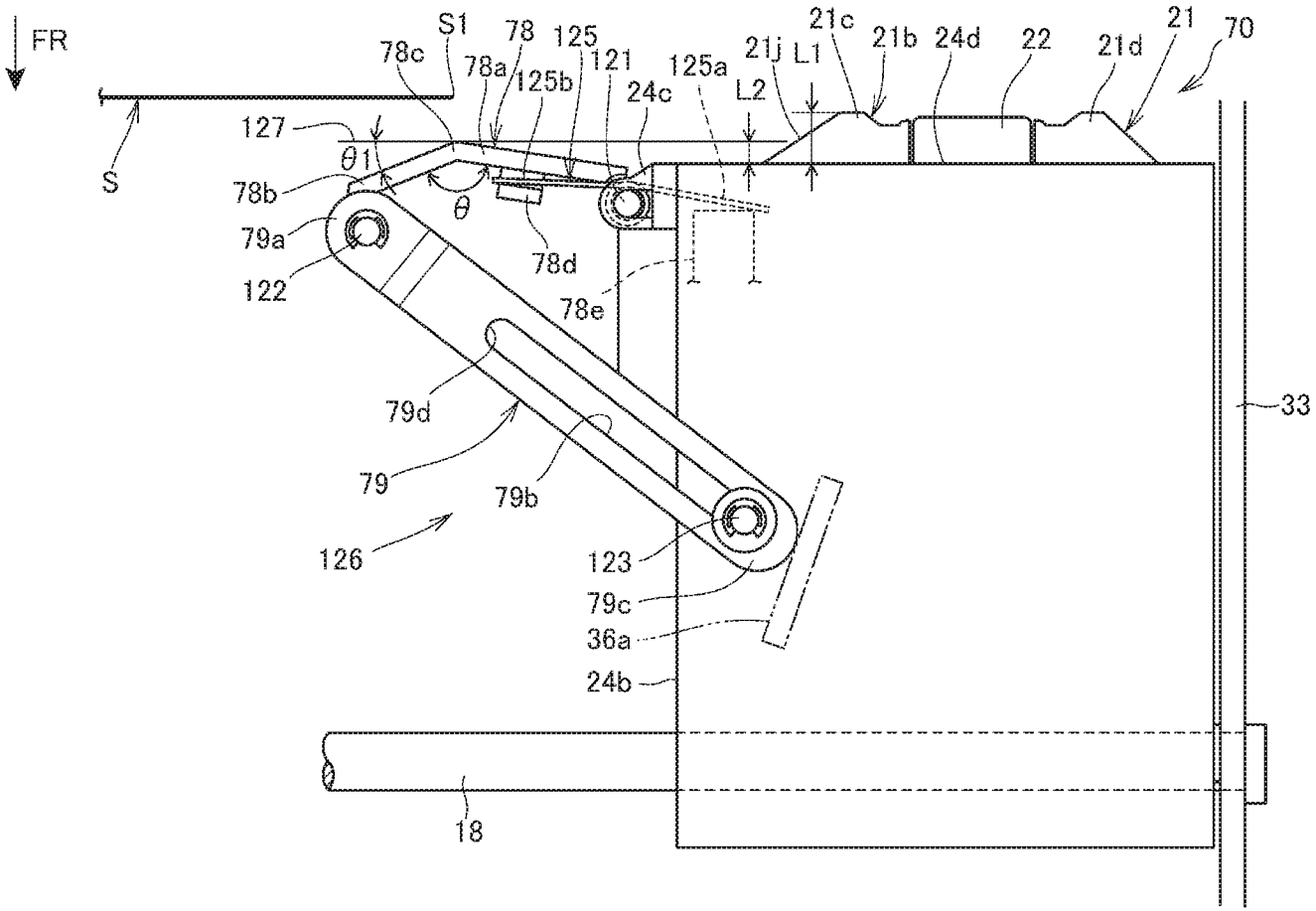
FIG. 5 is an enlarged view of main parts of the carriage assembly shown in FIG. 4.

The paper support mechanism 77 includes the panel member 78, a link member 79, a stop 36*a*, and a torsion spring 125 (see FIG. 5).

One end of the panel member 78 is pivotably supported on the carriage 21. One end of the link member 79 is pivotably connected to the distal end of the panel member 78, and the middle part of the link member 79 can slide to the top of the carriage 21. The stop 36*a* is disposed to the top connector frame 36, and can contact the other end of the link member 79.

The panel member 78 is disposed to overlap the paper exit 4 widthwise to the printer 1 when the carriage 21 is in the home position. More specifically, when the right edge of the cut-sheet paper S is at the right edge of the paper exit 4, the panel member 78 is disposed overlapping the cut-sheet paper S widthwise to the printer 1.

FIG. 5 is an enlarged view of the carriage assembly 70 shown in FIG. 4.

Pin supports 24*c* are formed integrally to the back end of the left side 24*b* of the carriage 21, and the panel member 78 is pivotably attached to the pin supports 24*c* through a first support pin 121.

The panel member 78 is formed so that two flat parts 78*a*, 78*b* bend convexly to the back at an angle ∠ at inflection part 78*c*, and a spring catch 78*d* is formed on the front part of the one flat part 78*a*. The ends 125*a*, 125*b* of the torsion spring 125, which winds around the first support pin 121, engage the spring catch 78*d* and a spring support 78*e* formed inside the carriage 21. As a result, the panel member 78 is urged counterclockwise around the first support pin 121 by the torsion spring 125.

One end 79*a* of the link member 79 is pivotably connected through a second support pin 122 to the distal end of the panel member 78. The link member 79 is a straight plate, and has a slot 79*b* formed lengthwise to the link member 79. A third support pin 123 attached to the top of the carriage 21 passes through the slot 79*b*.

The stop 36*a* of the top connector frame 36 (FIG. 4) is a flat part formed by bending part of the top connector frame 36 up.

As shown in the figure, when the carriage 21 is at the home position, the other end 79*c* of the link member 79 is against the stop 36*a* of the top connector frame 36. As a result, the panel member 78 and link member 79 protrude to the left side of the carriage 21.

At this time, at least flat part 78*b* of the panel member 78 overlaps the cut-sheet paper S widthwise. The edge of the cut-sheet paper S can therefore be prevented from falling into the path of carriage 21 movement.

The link member 79, stop 36*a*, and torsion spring 125 embody a moving mechanism 126 that causes the panel member 78 to swing and protrude to the cut-sheet paper S side, or causes the panel member 78 to retract to the side of the carriage 21.

When in the home position, the flat part 78*b* of the panel member 78 inclines so that the left end is closer to the front than the right end. The angle of inclination of the flat part 78*b* is angle ∠1 to a line 127 extending widthwise. By providing this angle ∠1, even if the cut-sheet paper S tilts into the path of carriage 21 movement, the edge S1 of the cut-sheet paper S will be caught by the flat part 78*b* and prevented from contacting the carriage 21.

The distance from a reference surface 24*d* extending width wise and disposed to the back 21*b* of the carriage 21, to the highest parts of lands 21*c*, 21*d* of the carriage 21, is L1. The inflection part 78*c* of the panel member 78 is separated distance L2 from the back of the reference surface 24*d* of the carriage 21.

Because distance L2 is shorter than distance L1, line 127 tangent to inflection part 78*c* intersects the outside slope 21*j* of the left land 21*c*. More specifically, when the cut-sheet paper S is in contact with the inflection part 78*c* and the carriage assembly 70 moves widthwise to the back, the edge of the cut-sheet paper S contacts the outside slope 21*j* of the left land 21*c*. When the edge of the cut-sheet paper S contacts the outside slope 21*j* of the land 21*c*, the cut-sheet paper S moves along the outside slope 21*j* and is guided to the back (behind) the inkjet head 22, and the cut-sheet paper S can be conveyed and printed on without interference.

Figure 6:
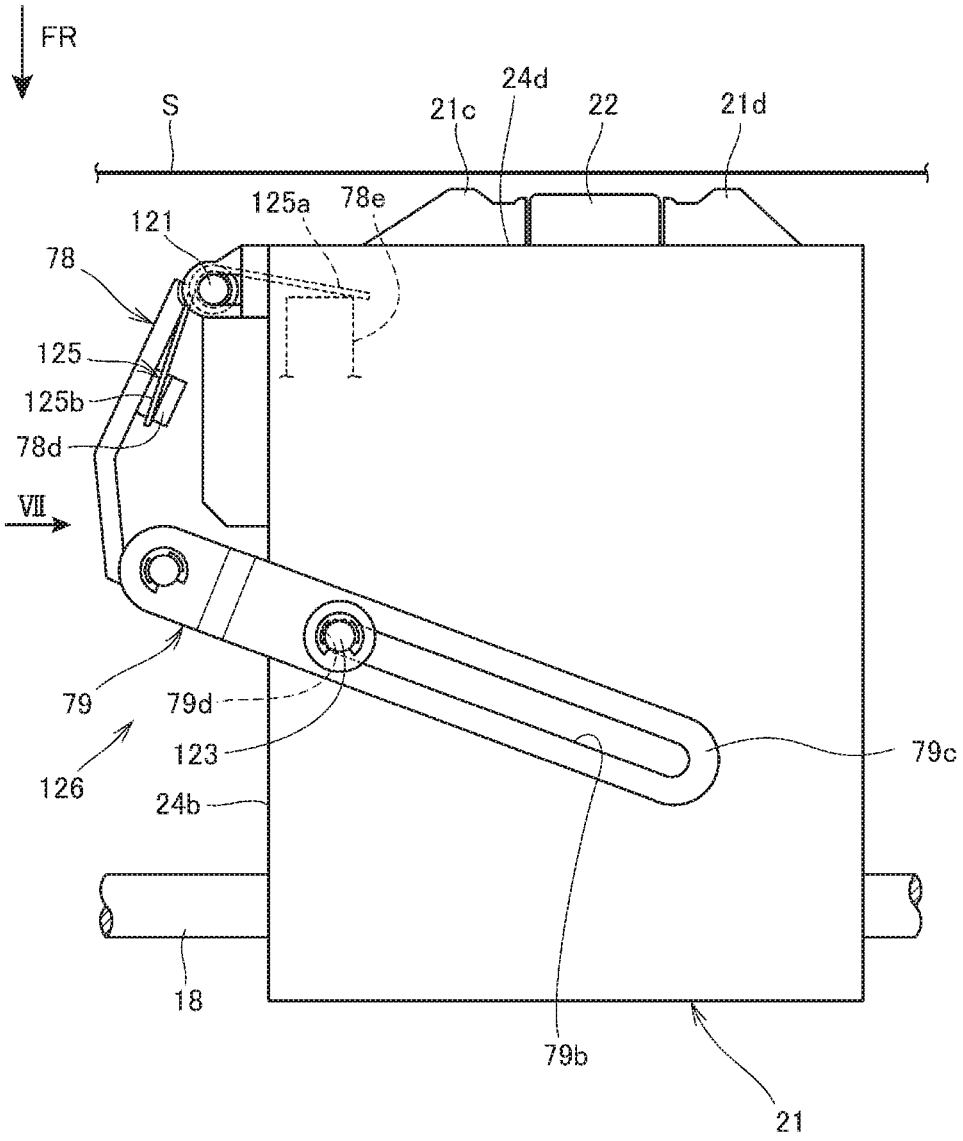
FIG. 6 is a plan view of main parts when a panel member is stored beside the carriage.
Figure 7:
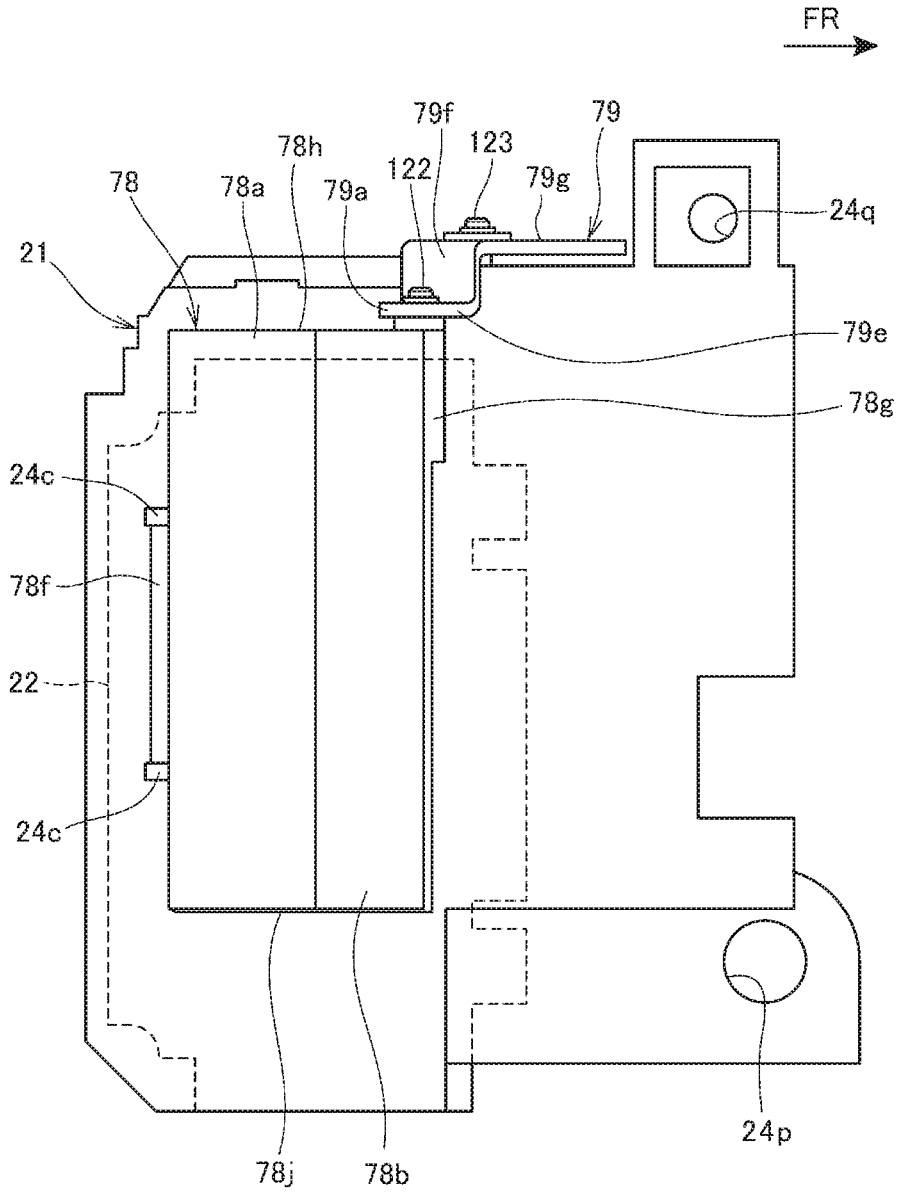
FIG. 7 is a section view through VII in FIG. 6.

FIG. 6 is a plan view showing the panel member 78 stored to the side of the carriage 21. FIG. 7 is a section view through arrow VII in FIG. 6.

As shown in FIG. 6, when the carriage 21 is positioned in the range in which printing by the inkjet head 22 is possible, the panel member 78 is stored to the left side of the carriage 21 alongside the left side 24*b* of the carriage 21 by the urging force of the torsion spring 125. Because the other end 79*c* of the link member 79 is separated from the stop 36*a* (FIG. 5)

of the top connector frame 36 (FIG. 4) at this time, the panel member 78 is stored as described above by the urging force of the torsion spring 125.

The panel member 78 being stored means that the panel member 78 is positioned alongside the left side 24*b* of the carriage 21 in front of the reference surface 24*d* of the carriage 21. The storage position of the panel member 78 is determined by the left end 79*d* (see also FIG. 5) of the slot 79*b* in the link member 79 contacting the third support pin 123.

As shown in FIG. 7, the panel member 78 has a first supported part 78*f* formed in the middle of the height of the edge of the flat part 78*a*, and a second supported part 78*g* formed in the top of the edge of the panel member 78.

FIG. 6 and FIG. 7, the first supported part 78*f* is supported by the vertical pair of pin supports 24*c* through a first support pin 121 (see FIG. 6). The second supported part 78*g* is supported through a second support pin 122 by the link member 79.

The link member 79 includes a lower leg 79*e*, connector 79*f*, and upper leg 79*g* formed in order from the one end 79*a*. The lower leg 79*e* is connected to the second supported part 78*g* through the second support pin 122. The upper leg 79*g* is a part formed a step higher than the lower leg 79*e*. The connector 79*f* connects the lower leg 79*e* and upper leg 79*g*.

A bearing 24*p*, which is a through-hole in which the guide rail 18 (FIG. 3) fits and can move, is opened in the front bottom part of the carriage 21. Bearings 24*q*, which are through-holes in which the guide rail 74 (FIG. 3) fits and can move, are opened in the front top and bottom back parts of the carriage 21.

When seen from the side, the top edge 78*h* of the panel member 78 is located above the top end of the inkjet head 22, and below the top end of the carriage 21 and bearing 24*q*. In side view, the bottom end 78*j* of the panel member 78 is located above the bottom end of the carriage 21, the bottom end of the inkjet head 22, and the two bearings 24*p*, 24*q*.

Figure 8:
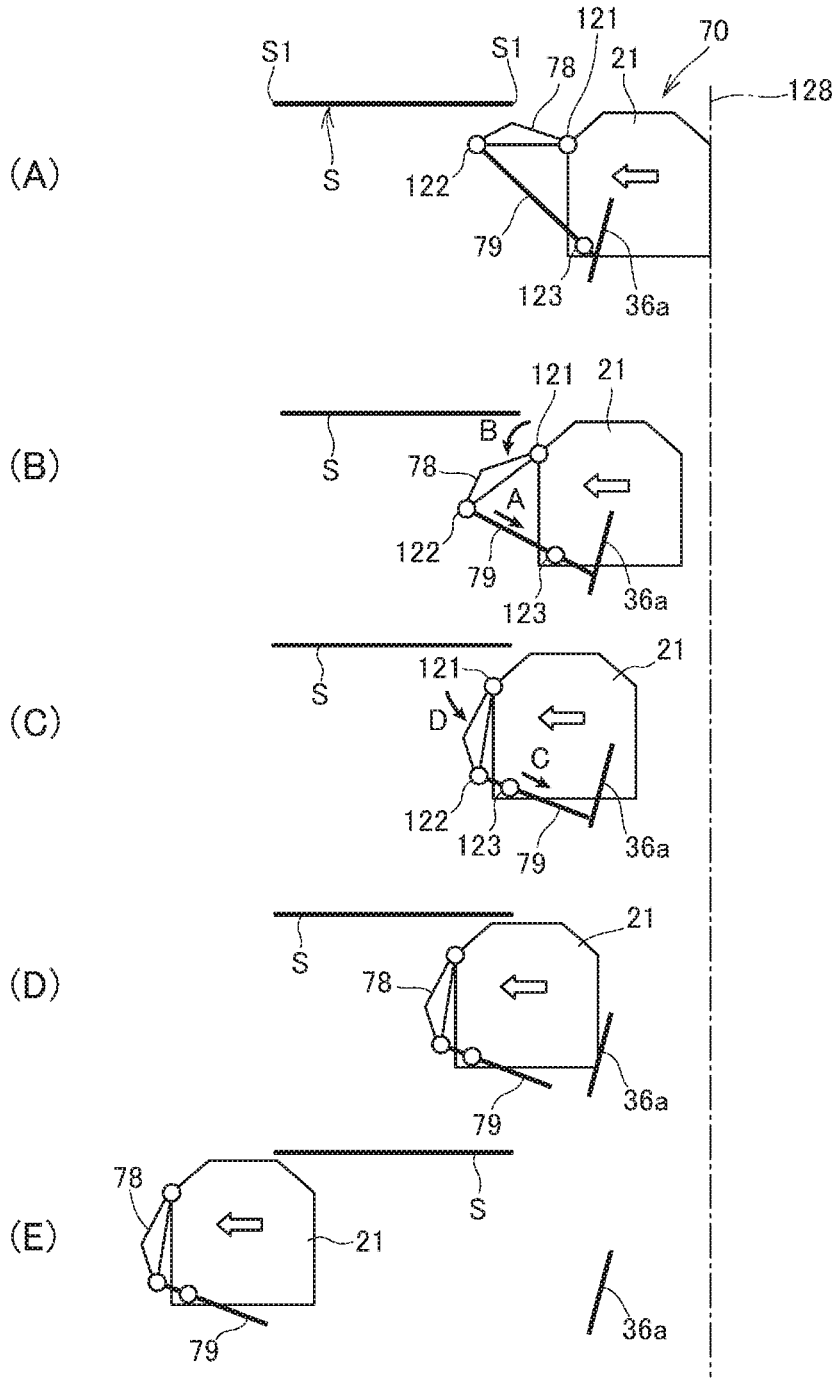
FIG. 8 illustrates the operation of the paper support mechanism paper support mechanism in the first embodiment of the invention, and shows the movement of the panel member when the carriage moves from the home position to the printing position.

FIG. 8 illustrates the operation of the paper support mechanism 77.

FIG. 8 (A) to FIG. 8 (E) illustrate the movement of the panel member 78 when the carriage 21 moves from the home position to the printing position. To facilitate understanding change in the operation of the carriage assembly 70, the imaginary line 128 in the figure indicates the right end of the home position of the carriage 21. The white arrow in the figure indicates the direction of carriage 21 movement.

FIG. 8 (A) shows the carriage 21 waiting in the home position. Because the other end of the link member 79 is against the stop 36*a*, and the link member 79 is beside the carriage 21, the panel member 78 also protrudes beside the carriage 21 and in front of the cut-sheet paper S. As a result, the cut-sheet paper S can be prevented by the panel member 78 from falling into the path of carriage 21 movement, and problems conveying the cut-sheet paper S are not caused by the carriage 21 contacting the edge of the cut-sheet paper S.

FIG. 8 (B) shows the carriage 21 when it starts moving to the left from the home position. At this time the other end of the link member 79 is still in contact with the stop 36*a*. As the carriage 21 moves, the link member 79 slides relative to the carriage 21 in the direction of arrow A, and protrusion of the link member 79 to the left side of the carriage 21 decreases. As a result, protrusion of the panel member 78 to the side of the carriage 21 also decreases. As indicated by arrow B, the panel member 78 also swings counterclockwise on the first support pin 121.

FIG. 8 (C) shows when the carriage 21 has moved further to the left, and the other end of the link member 79 has begun to separate from the stop 36*a*. The link member 79 has slid relative to the carriage 21 as indicated by arrow C, and the panel member 78 has moved counterclockwise on the first support pin 121 as indicated by arrow D. As a result, protrusion of the link member 79 to the left side of the carriage 21 is minimized, and the panel member 78 has swung the greatest distance counterclockwise. In this position, the panel member 78 is stored by the left side of the carriage 21 as shown in FIG. 6. Because the carriage 21 is located in front of the cut-sheet paper S at this time, the carriage 21 can prevent the cut-sheet paper S from falling forward.

FIG. 8 (D) shows the carriage 21 moved yet further to the left, and positioned to the right end of the printable range of the inkjet head 22 (see FIG. 6).

FIG. 8 (E) shows the carriage 21 moved yet further to the left, and positioned to the left end of the printable range of the inkjet head 22.

As described above, when the carriage 21 moves through the printable range of the inkjet head 22, the panel member 78 is stored at the side of the carriage 21. In other words, because the other end of the link member 79 is not in contact with the stop 36*a*, and external force is not applied to the carriage 21, printing by the inkjet head 22 is not affected.

Embodiment 2

Figure 9:
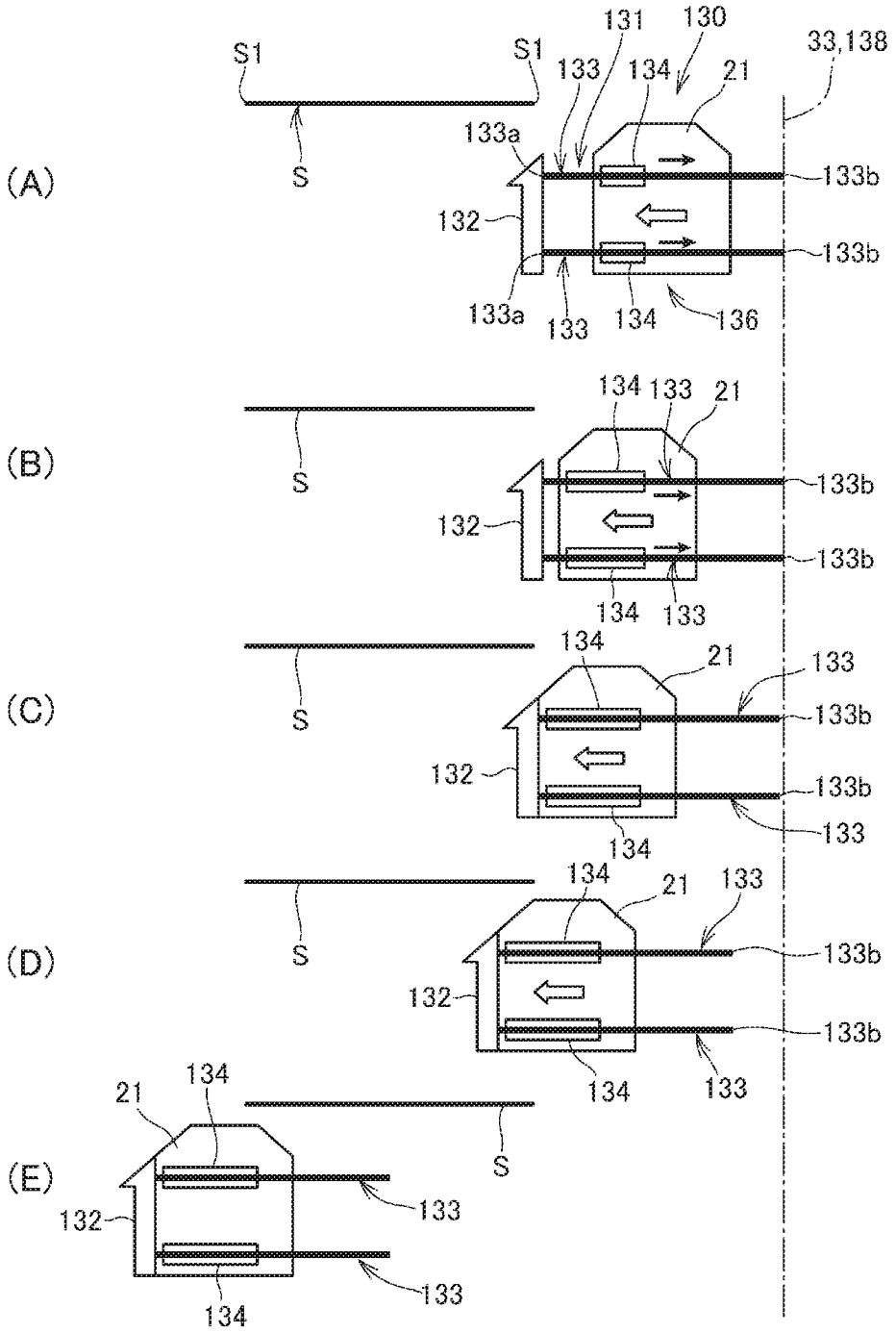
FIG. 9 illustrates the structure and operation of a paper support mechanism according to a second embodiment of the invention.

FIG. 9 illustrates the configuration and operation of a paper support mechanism 131 according to a second embodiment of the invention.

FIG. 9 (A) illustrates the configuration and operation of the paper support mechanism 131, and FIG. 9 (B) to FIG. 9 (E) illustrate the operation of the paper support mechanism 131. Imaginary line 138 in the figure indicates the right end of the home position of the carriage 21 to facilitate understanding change in the operation of the carriage assembly 130. More specifically, imaginary line 138 indicates the right side frame 33. The white arrows in the figure indicate the direction of carriage 21 movement, and the solid black arrows indicate the force of slide rods 133 against the right side frame 33.

As shown in FIG. 9 (A), the paper support mechanism 131 includes a protrusion 132, multiple slide rods 133, the right side frame 33, and coil compression springs 134. The carriage 21 and paper support mechanism 131 embody the carriage assembly 130.

The protrusion 132 is a member that protrudes in front of the cut-sheet paper S when the carriage 21 is in the home position, and by protruding in front of the cut-sheet paper S prevents the cut-sheet paper S from falling into the path of carriage 21 movement.

The slide rods 133 are supported movably by the carriage 21, and one end 133*a* of the slide rods 133 is attached to the protrusion 132. The right side frame 33 is a contact part that the other end 133*b* of the slide rods 133 contacts.

The compression springs 134 are urging members that urge the multiple slide rods 133 to the opposite side of the carriage 21 as the side to which the protrusion 132 protrudes.

The slide rods 133 are inserted to the compression springs 134, the left ends of the compression springs 134 are supported on an inside wall of the carriage 21, and the right ends of the compression springs 134 are supported by protrusions disposed along the length of the slide rods 133. As a result, the compression springs 134 are disposed compressed between the inside wall of the carriage 21 and the protrusions of the slide rods 133.

The slide rods 133, right side frame 33, and compression springs 134 embody a moving mechanism 136 that moves the protrusion 132 to protrude to the cut-sheet paper S side, or stores the protrusion 132 at the side of the carriage 21.

FIG. 9 (A) shows the carriage 21 waiting at the home position. The other ends 133*b* of the multiple slide rods 133 are touching the right side frame 33, and the multiple slide rods 133 protrude to the left side of the carriage 21. The protrusion 132 there also protrudes in front of the cut-sheet paper S on the left side of the carriage 21. As a result, the protrusion 132 prevents the cut-sheet paper S from falling into the path of carriage 21 movement, and problems conveying the cut-sheet paper S are not caused by the carriage 21 contacting the edge of the cut-sheet paper S.

FIG. 9 (B) shows the carriage 21 when it starts moving to the left from the home position. At this time the other ends 133*b* of the multiple slide rods 133 are still touching the right side frame 33. As the carriage 21 moves, the protrusion of the slide rods 133 to the left side of the carriage 21 decreases, and protrusion of the protrusion 132 to the side of the carriage 21 also decreases.

FIG. 9 (C) shows when the carriage 21 has moved further to the left, and the other ends 133*b* of the slide rods 133 have begun to separate from the right side frame 33. As a result, protrusion of the slide rods 133 to the left side of the carriage 21 is minimized, and the slide rods 133 are not pushing against the right side frame 33. In this position, the protrusion 132 is stored at the left side of the carriage 21. Because the carriage 21 is located in front of the cut-sheet paper S at this time, the carriage 21 can prevent the cut-sheet paper S from falling forward.

FIG. 9 (D) shows the carriage 21 moved yet further to the left, and positioned to the right end of the printable range of the inkjet head 22 (see FIG. 6).

FIG. 9 (E) shows the carriage 21 moved yet further to the left, and positioned to the left end of the printable range of the inkjet head 22.

As described above, when the carriage 21 moves into the printable range of the inkjet head 22, the carriage 21 can prevent the cut-sheet paper S from dropping into the path of carriage 2*l* movement. Furthermore, because the protrusion 132 is stored in the side of the carriage 21, the other ends 133*b* of the slide rods 133 do not contact the right side frame 33, external force is not applied to the carriage 21, and printing by the inkjet head 22 is not affected.

As shown in FIG. 3 and FIG. 4, the carriage configuration carries an inkjet head 22 as the printhead; and comprises, disposed to a carriage 21 that moves bidirectionally in a range of movement including the conveyance path of a cut-sheet paper S as the conveyed print medium, a panel member 78 as a protruding member that can protrude into the path of carriage 21 movement; and a moving mechanism 126 that causes the panel member 78 to protrude to the cut-sheet paper S conveyance path side when the carriage 21 is positioned to a standby position (home position) set in the range of carriage 21 movement.

By making the moving mechanism 126 cause the panel member 78 to protrude into the conveyance path of the cut-sheet paper S from the carriage 21 at the standby position, cut-sheet paper S can be prevented from falling into the path of carriage 21 movement, and the edge S1 of the cut-sheet paper S can be prevented from contacting the carriage 21, without providing a discharge roller and a drive mechanism for the discharge roller. As a result, the cost and size of the printer 1 can be reduced without inviting problems with cut-sheet paper S conveyance.

As shown in FIG. 6, because the moving mechanism 126 stores the panel member 78 at the side of the carriage 21 when the carriage 21 moves from the standby position to the cut-sheet paper S conveyance path side, protrusion of the panel member 78 from the carriage 21 can be further decreased in the direction of carriage 21 movement, and the size of the printer 1 in which the carriage 21 is used (particularly the width of the printer 1) can be reduced.

As shown in FIG. 5, the protrusion is a panel member 78 with one end thereof supported pivotably on the carriage 21; and the moving mechanism 126 includes a link member 79 connected pivotably to the other end of the panel member 78 and supported slidably in relation to the carriage 21, and a torsion spring 125 as an urging member that pulls the panel member 78 to the carriage 21. Furthermore, because the link member 79, when the carriage 21 is at the standby position, contacts a stationary stop 36*a* disposed outside the range of carriage 21 movement, and protrudes with the panel member 78 to the cut-sheet paper S conveyance path side, the panel member 78 can also be considered a protrusion, and the cut-sheet paper S can be even more reliably prevented by the panel member 78 from falling into the path of carriage 21 movement.

Furthermore, because the panel member 78 can be swung by the moving mechanism 126 and stored beside the carriage 21, the size of the printer 1 in which the carriage 21 is used (see FIG. 3) can be reduced.

Furthermore, because the carriage 21 moving to the standby position sets the link member 79 against the stop 36*a*, the panel member 78 can be automatically projected to the cut-sheet paper S conveyance path side, a drive power source for moving the panel member 78 is not needed, and increasing the cost of the printer 1 can be suppressed.

Furthermore, a moving mechanism 136 as shown in FIG. 9 (A) has slide rods 133, as an example of multiple rods, fastened at one end to a protrusion 132 and supported slidably to the carriage 21; and compression springs 134, as an example of an urging member, that pull the slide rods 133 to the carriage 21. Because, when the carriage 21 is at the standby position, the slide rods 133 contact the right side frame 33, as an example of a stationary contact part (stop) outside the range of carriage 2*l* movement, and push the protrusion 132 to protrude to the cut-sheet paper S conveyance path side, the protrusion 132 can be moved by the moving mechanism 136 and stored near the carriage 21.

The size of the printer 1 in which the carriage 21 is used (see FIG. 3) can therefore be reduced.

The protrusion 132 can also be made to automatically project to the cut-sheet paper S conveyance path side because movement of the carriage 21 to the standby position causes the slide rods 133 to contact the right side frame 33. A drive source for projecting the protrusion 132 is therefore not needed, and increasing the cost of the printer 1 can be suppressed.

As shown in FIG. 3 and FIG. 4, a printer 1 according to the invention includes a inkjet head 22 and a carriage 21 that carries the inkjet head 22; prints by moving the carriage 21 bidirectionally through a range of movement including the conveyance path of the cut-sheet paper S; and includes, disposed to the carriage 21, a panel member 78 that can protrude in the direction of carriage 21 movement; and a moving mechanism 126 that causes the panel member 78 to protrude to the cut-sheet paper S conveyance path side when the carriage 21 is positioned to a standby position set in the range of carriage 21 movement.

As shown in FIG. 9 (A), a printer 1 according to the invention includes a inkjet head 22 and a carriage 21 that carries the inkjet head 22; prints by moving the carriage 21 bidirectionally through a range of movement including the conveyance path of the cut-sheet paper S; and includes, disposed to the carriage 21, a protrusion 132 that protrudes in the direction of carriage 21 movement; and a moving mechanism 136 that causes the protrusion 132 to protrude to the cut-sheet paper S conveyance path side when the carriage 21 is positioned to a standby position set in the range of carriage 21 movement.

By making the moving mechanism 126, 136 cause the panel member 78 or protrusion 132 to protrude into the conveyance path of the cut-sheet paper S from the carriage 21 when at the standby position, cut-sheet paper S can be prevented from falling into the path of carriage 21 movement, and the edge S1 of the cut-sheet paper S can be prevented from contacting the carriage 21, without providing a discharge roller and a drive mechanism for the discharge roller. As a result, the cost and size of the printer 1 can be reduced without inviting problems with cut-sheet paper S conveyance.

The invention is described above with reference to a preferred embodiment thereof, but the invention is not limited thereto and can be modified and adapted in many ways without departing from the scope of the accompanying claims.

For example, as shown in FIG. 5, the panel member 78 protrudes to the left side of the carriage 21 in the embodiment described above, but the invention is not so limited and the panel member 78 may be configured to protrude to the right side of the carriage 21. Likewise, as shown in FIG. 9, the protrusion 132 protrudes to the left side of the carriage 21 in the embodiment described above, but the invention is not so limited and the protrusion 132 may be configured to protrude to the right side of the carriage 21.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A carriage configured to carry a printhead which prints on a print medium, the carriage comprising:

a panel member configured to have one end part supported pivotably to the carriage;

a link member, supported slidably to the carriage, configured to connect pivotably to another end part of the panel member;

an urging member configured to pull the panel member to the carriage, and wherein when the carriage is at a standby position, the link member touches a stationary contact part and protrudes with the panel member to the print medium.

2. The carriage structure described in claim 1, wherein:

when the carriage moves from the standby position, the panel member is stored beside the carriage by the urging member.

3. The carriage structure described in claim 1, wherein:

the moving mechanism includes multiple rods supported slidably in relation to the carriage with one end fastened to the protrusion, and an urging member pulling the rods to the carriage;

the rods touching a stationary contact part outside the range of carriage movement and causing the protrusion to protrude to the print medium conveyance path side, when the carriage is at the standby position.

4. A printer including a printhead configured to print a print medium, and a carriage configured to carry the printhead, the printer comprising:

a panel member configured to have one end part supported pivotably to the carriage;

a link member, supported slidably to the carriage, configured to connect pivotably to another end part of the panel member;

an urging member configured to pull the panel member to the carriage, and wherein when the carriage is at a standby position, the link member touches a stationary contact part and protrudes with the panel member to the print medium.

* * * * *